US006502986B1

(12) United States Patent
Bensur et al.

(10) Patent No.: US 6,502,986 B1
(45) **Date of Patent: *Jan. 7, 2003**

(54) PACKAGE HAVING RE-SEALABLE END CLOSURE AND METHOD FOR MAKING SAME

(75) Inventors: Francis J. Bensur, Noblesville, IN (US); Jeffrey M. Schuetz, Florence, SC (US); Richard Frederick Jaisle, Batesville, IN (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/596,309

(22) Filed: Jun. 18, 2000

Related U.S. Application Data

(63) Continuation-in-part of application No. 09/203,269, filed on Dec. 1, 1998, now Pat. No. 6,076,969.

(51) Int. Cl.[7] ..... B65D 33/20
(52) U.S. Cl. ..... 383/211; 383/95; 383/204
(58) Field of Search ..... 383/210, 211, 383/94, 95, 203, 204

(56) References Cited

U.S. PATENT DOCUMENTS

| | | | | |
|---|---|---|---|---|
| 3,406,039 A | | 10/1968 | Paufler | |
| 3,554,436 A | | 1/1971 | Palmer | |
| 3,613,874 A | | 10/1971 | Miller | |
| 4,572,377 A | | 2/1986 | Beckett | |
| 4,673,601 A | | 6/1987 | Lamping et al. | |
| 4,705,174 A | * | 11/1987 | Goglio | 383/210 |
| 4,785,940 A | | 11/1988 | Wilson | |
| 4,786,190 A | | 11/1988 | Van Erden et al. | |
| 4,944,409 A | | 7/1990 | Busche et al. | |
| 4,946,289 A | | 8/1990 | Bolling et al. | |
| 5,089,320 A | | 2/1992 | Straus et al. | |
| 5,172,854 A | | 12/1992 | Epstein et al. | |
| 5,346,301 A | | 9/1994 | Scarberry et al. | |
| 5,384,472 A | | 1/1995 | Yin | |
| 5,692,834 A | | 12/1997 | Pagano | |
| 5,832,145 A | | 11/1998 | Dais et al. | |
| 5,993,962 A | | 11/1999 | Timm et al. | |
| 6,076,969 A | * | 6/2000 | Jaisle et al. | 383/211 |

FOREIGN PATENT DOCUMENTS

| | | | | |
|---|---|---|---|---|
| DE | 3519688 | * | 12/1986 | 383/211 |
| EP | 0 516 276 A2 | * | 12/1992 | 383/211 |
| FR | 2686572 A1 | | 7/1993 | |
| JP | 1-308754 A | | 12/1989 | |

* cited by examiner

*Primary Examiner*—Jes F. Pascua
(74) *Attorney, Agent, or Firm*—Alston & Bird LLP

(57) ABSTRACT

A package having a re-sealable seal is formed from a flexible sheet having its opposite longitudinal edge portions sealed together to form a tubular structure with a permanent longitudinal seal. Two permanent end seals are formed transversely across the tubular structure to seal the product inside the package. A re-sealable seal is formed adjacent one of the permanent seals. The re-sealable seal is formed by a pressure-sensitive adhesive applied to a first region of the inner surface of the sheet proximate the one permanent seal and a heat seal coating applied over the pressure-sensitive adhesive so as to cover the pressure-sensitive adhesive. and a heat seal coating applied over a second region of the inner surface of the sheet. The first and second regions of the inner surface are placed in contact with each other and the heat seal coatings thereon are sealed together to initially form the re-sealable seal. When the first and second regions of the sheet are pulled apart upon opening of the package, the pressure-sensitive adhesive separates from the first region and remains with the second region. The second region is pressed against the first region to reclose the package.

15 Claims, 4 Drawing Sheets

PACKAGE HAVING RE-SEALABLE END CLOSURE AND METHOD FOR MAKING SAME

CROSS-REFERENCE TO RELATED APPLICATION

The present application is a continuation-in-part of U.S. patent application Ser. No. 09/203,269 filed Dec. 1, 1998, now U.S. Pat. No. 6,076,969.

FIELD OF THE INVENTION

The present invention relates to flexible product packages and. more particularly. to a flexible product package having a resealable closure.

BACKGROUND OF THE INVENTION

Product packages having reclosure mechanisms arc often employed for packaging products in situations where the consumer may wish to remove only a portion of the product and to reclose the package. Particularly with the current popularity of "fat-free" food products, some of which readily dry out if left exposed to atmosphere, there is a significant interest on the part of the product manufacturers in easily and inexpensively produced packaging which can be repeatedly opened and reclosed. Flexible packaging produced from flexible sheet materials are generally favored for reasons of cost, functionality, and marketing appeal.

Various types of reclosure mechanisms have been developed for reclosing, a flexible package to keep unused portions of a food product fresh. Many of these mechanisms are separately manufactured articles which arc added to the package either in a subsequent manufacturing step or by the consumer, such as zippers, reclosure tapes or tabs, seal strips. clips, and the like. However, such mechanisms are disadvantageous because they necessitate additional manufacturing operations and materials, thus increasing manufacturing cost. Accordingly, efforts have been made toward developing adhesive-based reclosure mechanisms for flexible packages, since such packaging is readily produced on automated flexible web-handling machinery and does not require additional components such as zippers or the like.

The challenge in making a reclosure mechanism which relies on adhesive for resealing is that an adhesive which may be suitable for forming the original package seal, which must have sufficient strength and integrity to prevent inadvertent opening of the package and to keep the product fresh during handling and shipment, is generally different from the type of adhesive which is desirable from a resealing point of view. Cold seals, hot-melts, and heat seals provide good seal strength and are thus suitable for forming original package seals. Unfortunately, such materials do not generally provide sufficient reclosure capabilities. Pressure-sensitive adhesives can be repeatedly removed and reattached to suitable substrates and thus can provide reclosure capabilities. However, pressure-sensitive adhesives do not provide sufficient closure strength to form reliable original package seals in many applications. Furthermore, because pressure-sensitive adhesives are inherently tacky and will stick to almost any surface they come in contact with, automated handling of sheets or webs to which pressure-sensitive adhesives have been applied is difficult. For example, the pressure-sensitive adhesive may become stuck to the rollers of an apparatus, a problem known in the industry as "picking." Additionally, the web may stick to itself when it is wound into a roll and stored prior to being used, a problem known as "blocking."

Accordingly, pressure-sensitive adhesives are commonly used in conjunction with backing layers of paper or other material to which a release coating has been applied, as shown in U.S. Pat. No. 3,827,625. When it is desired to operate a seal employing such a pressure-sensitive adhesive mechanism, the backing layer is removed to expose the pressure-sensitive adhesive, and the pressure-sensitive adhesive is pressed against a cooperating part of the package to effect a closure, whether an original seal or a reclosure of a previously opened seal. Alternatively, the backing layer is permanently attached to the cooperating part of the package to effect an original seal, and the substrate which carries the pressure-sensitive adhesive is peeled from the backing layer to open the original seal. as shown in U.S. Pat. No. 3,272,422. In either case, reclosure is effected by pressing the pressure-sensitive adhesive against the cooperating part or the backing layer.

The disadvantages of such closure mechanisms are that additional material and manufacturing operations are required to form the backing layer, and the strength of the original seal is only as good as the strength of the pressure-sensitive adhesive, which as previously noted is insufficient in many cases.

The assignee of the present application has previously developed a reclosure mechanism for a flexible package, as disclosed in co-pending U.S. patent application Ser. No. 09/203,269. which is incorporated herein by reference. The '269 application describes a package having, a re-sealable seal formed by a layer of pressure-sensitive adhesive applied to the inner surface of one portion of the packaging sheet adjacent an edge thereof. and a layer of a cohesive material such as a cold seal or heat seal applied over the pressure-sensitive adhesive and over a surface of an opposing portion of the sheet that is placed in contact with the one portion and sealed thereto to form a package seal. When the seal is first opened. the pressure-sensitive adhesive detaches from the one portion of the sheet so that it is attached to and exposed on the opposing portion of the sheet. The package is reclosed by pressing the two portions together to cause the pressure-sensitive adhesive to stick to the one portion. The '269 application further describes that a second seal may be formed immediately adjacent to the edge of the sheet outward of the re-sealable seal so as to improve the strength of the original package seal along this edge. The second seal is formed by a strip of the cohesive material applied to the inner surface of the sheet without the interposition of any pressure-sensitive adhesive facing portions of the sheet being sealed together along the edge via this strip of cohesive.

SUMMARY OF THE INVENTION

The present invention was developed to further improve upon the package disclosed in the '269 application, with a particular emphasis being to provide a package especially suitable for vertical form, fill, and seal (VFFS) applications. Where a cold seal material is used for forming the re-sealable seal and second seal in the package of the '269 application, the seals do not develop their full strength immediately upon sealing, but rather can take a substantial amount of time, tip to several hours, before they reach their full strength. Immediately after sealing, these seals tend to be fairly weak, and thus may not be capable of withstanding the forces exerted on them in a VFFS packaging operation, where the weight of the package contents bears upon the seal when the package is filled. Cold seal materials also tend to be tacky and will not flow freely through VFFS machines. The present invention was developed to address these problems.

In accordance with a preferred embodiment of the present invention, a package having a re-sealable seal is formed from a flexible sheet having its opposite longitudinal edge portions sealed together to form a tubular structure with a permanent longitudinal seal extending lengthwise thereal-ong. Two opposite permanent end seals are formed transversely across the tubular structure to seal the product inside the package. At one end of the package, a re-sealable seal is formed adjacent the permanent end seal. In this embodiment, the package is opened at the end of the package having the re-sealable seal. The re-sealable seal is formed by a pressure-sensitive adhesive applied to a first region of the inner surface of the sheet proximate the end seal and a heat seal coating applied over the pressure-sensitive adhesive so as to cover the pressure-sensitive adhesive, and a heat seal coating applied over a second region of the inner surface of the sheet. The first and second regions of the inner surface are placed in contact with each other and have the heat seal coatings thereon sealed together so as to form the re-sealable seal.

In an alternative embodiment of the invention, the re-sealable seal is formed so as to extend longitudinally along the package adjacent to the permanent longitudinal seal. In this embodiment, the package is opened along the longitudinal seal.

The heat seal coating provides a relatively strong seal immediately upon sealing. This is advantageous particularly for VFFS applications where the resealable seal is at one end of the package such that the weight of the package contents bears upon the seal. In a preferred embodiment of the invention. the sheet's inner surface comprises a heat-sealable material. The sheet can comprise a lamination of more than one layer, the inner layer comprising a heat-sealable material. Alternatively, heat seal coatings can be applied to the inner surface of the sheet for making the permanent heat seals. The permanent seals are formed by heat sealing via the heat-sealable material on the inner surface. Preferably, the seal coating covering the pressure-sensitive adhesive is also a heat seal coating. Accordingly the permanent seal and the adjacent re-sealable seal can both be formed by heat sealing, and advantageously can be formed simultaneously during a packaging operation.

In accordance with a particularly preferred method of the invention, which can be used in VFFS and other applications, a continuous web of the sheet material is advanced and a leading portion of the advancing web is folded and has its longitudinal edge portions sealed together to form a tubular structure. A transverse seal is formed across the tubular structure to form a first end seal for a package and the product is placed into the package before or after the first end seal is formed. A second end seal on the opposite end of the package is then formed along with the re-sealable seal, and the resulting package is severed from the remainder of the web. Advantageously, the first end seal for one package and the second end seal and re-sealable seal for the adjoining package can be formed simultaneously.

In an alternative method embodiment of the invention, the web is advanced and is folded into a tubular shape, and the opposite longitudinal edges are sealed together with both a permanent seal and an adjacent re-sealable seal having the construction described above. One permanent end seal is formed transversely across the package, and the contents are placed in the package, and the opposite permanent end seal is formed and the package is severed from the rest of the web.

Preferably, the package and method of the invention also include the formation of an easy-open feature located between the permanent seal and the adjacent re-sealable seal, enabling the package to be easily opened to gain access to the contents. In a preferred embodiment of the invention. the easy-open feature enables the part of the package having the permanent seal to be torn off the package so that the re-sealable seal is all that remains for sealing the package)e opening. The consumer can then open the re-sealable seal, remove a portion of the contents, and reclose the package by operating the re-sealable seal. Alternatively, the easy-open feature may create an opening through the sheet to enable the user to then open the re-sealable seal without tearing the permanent seal from the package. The easy-open feature may comprise a perforation, a tear strip, a mechanically formed or laser-formed scoreline, or the like.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF THE DRAWINGS

The present invention now will be described more fully hereinafter with reference to the accompanying drawings, in which preferred embodiments of the invention are shown. This invention may, however, be embodied in many different forms and should not be construed as limited to the embodiments set forth herein; rather. these embodiments are provided so that this disclosure will be thorough and complete, and will fully convey the scope of the invention to those skilled in the art. Like numbers refer to like elements throughout.

The present invention represents a further development of the technology disclosed in the parent application Ser. No. 09/203,269. The disclosure of the '269 application is not repeated herein for the sake of brevity, but is incorporated herein by reference.

Figure 1:
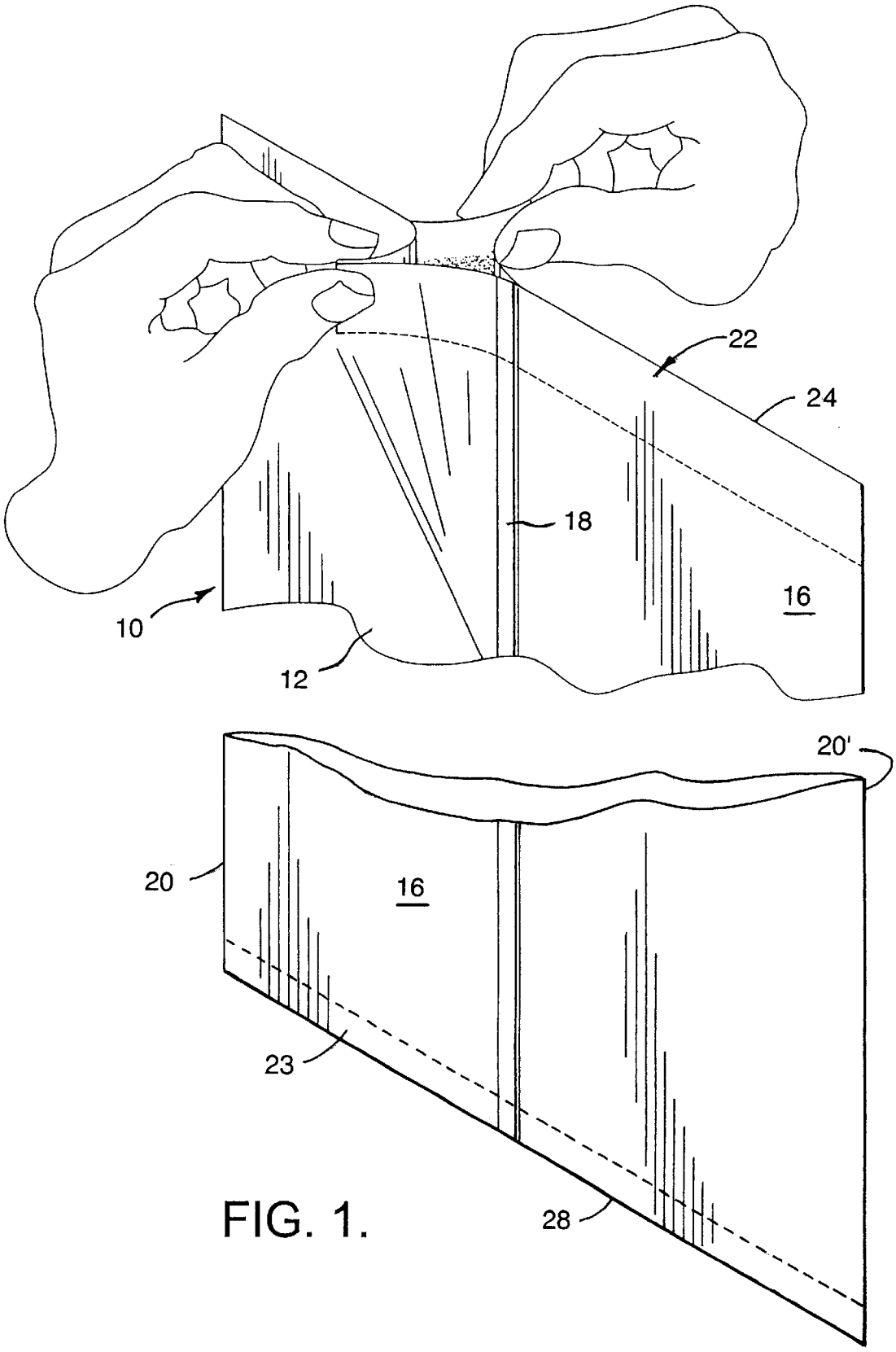
FIG. 1 is a fragmentary perspective view of a package in accordance with an embodiment of the present invention, showing the end of the package having the regarding-sealable seal and showing the seal being opened.
Figure 2:
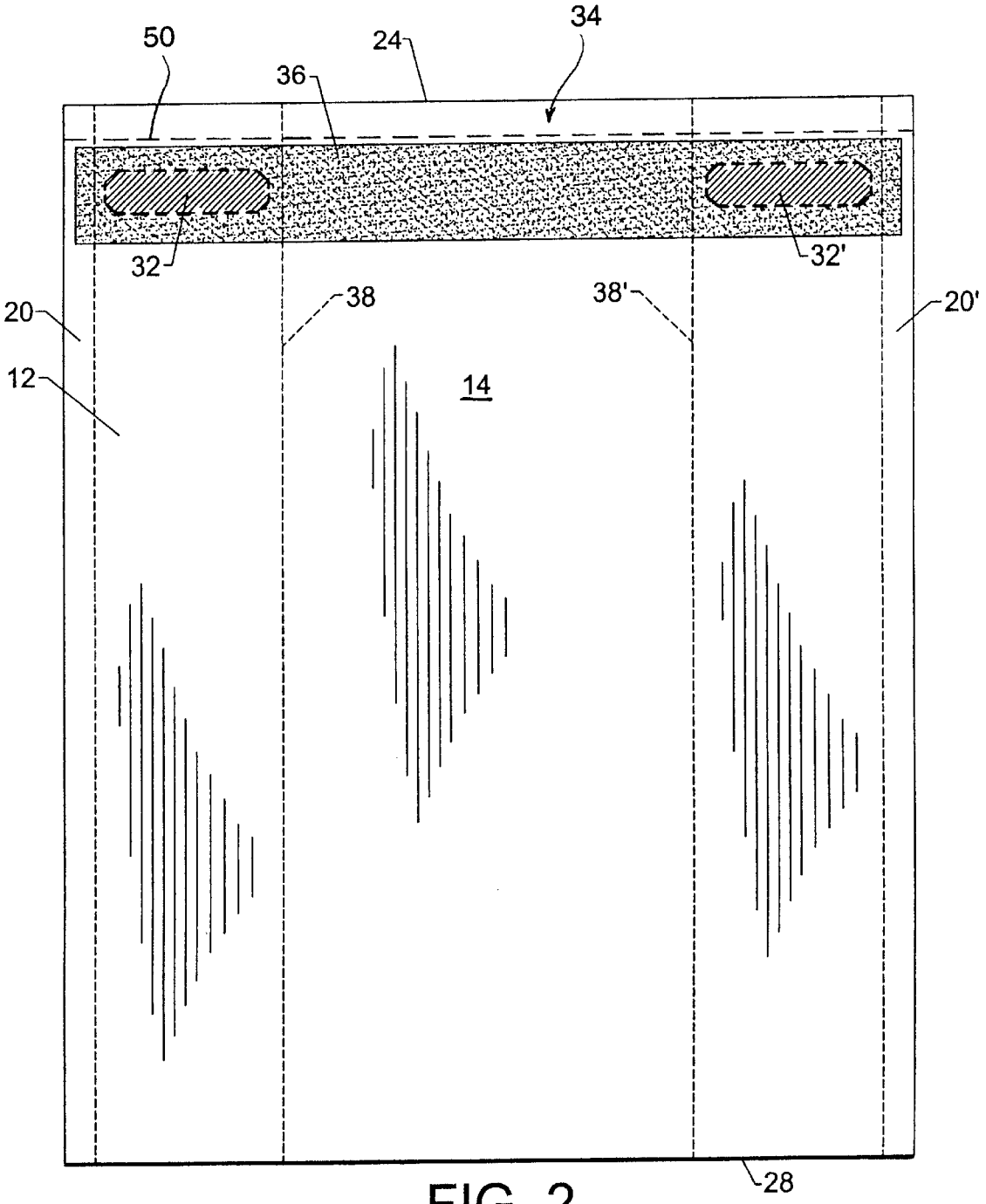
FIG. 2 is a plan view of the packaging sheet used for forming the package of FIG. 1, shown in an unwrapped, flat condition.

FIG. 1 depicts a package 10 in accordance with one preferred embodiment of the invention. The package 10 is formed of a flexible sheet 12 which can suitably be made of one or more layers of flexible materials including one or more of polymers, metal foils, papers, and the like, as further described below. The sheet 12 is shown in an unwrapped, flat condition in FIG. 2. The surface 14 of the sheet visible in FIG. 2 forms the inner surface of the package 10, and is referred to herein as the inner surface 14 of the sheet. The opposite outer surface 16 of the sheet is visible in FIG. 1. The package 10 includes a permanent longitudinal fin seal 18 formed by scaling the inner surface 14 of the sheet along one longitudinal edge portion 20 to the inner surface of the sheet along the opposite longitudinal edge portion 20', thus forming, a tubular structure. Attentively, the longitudinal seal 18 could be a lap seal rather than a fin seal. A first end seal 22 is formed transversely across this tubular structure adjacent a first edge 24 of the sheet 12 to close one end of the package. A second end seal 23, similar to the first end seal 22, is formed across the tubular structure adjacent the opposite second edge 28 of the sheet to close the other end of the package. The longitudinal and end seals are sometimes referred to herein as "permanent" seats, which is not meant to imply that the seals are impossible to open, but rather denotes that they are designed to be sufficiently strong by themselves to remain sealed until the consumer opens them. In other words, a "permanent" seal as referred to herein is a typical type of seal (e.g.,. a heat seal) commonly used in sealing packages of the described type.

A re-sealable seal 30 is formed proximate, and preferably spaced from, the first permanent end seal 22, the re-sealable seal 30 extending generally parallel to the first end seal 22. The construction of the re-sealable seal 30 is explained with reference to FIGS. 2 and 3. The re-sealable seal 30 is formed by a layer of pressure-sensitive adhesive (PSA) applied to the inner surface 14 of the sheet in two discrete regions 32 and 32' spaced a small distance from the first edge 24 and spaced on opposite sides of a center region 34 of the inner surface. The re-sealable seal 30 further includes a heat seal coating 36 applied to the inner surface 14 of the sheet so as to cover the PSA in the regions 32, 32' and so as to also cover the center region 34 of the inner surface located inward of the PSA regions 32, 32'. When the longitudinal edge portions 20, 20' of the sheet are sealed together to form the permanent fin seal 18, the sheet is folded about longitudinally extending fold lines 38, 38' so as to position the PSA regions 32, 32' in opposition to the heat seal coating 36 on the center region 34 of the sheet. The re-sealable seal 30 is formed by sealing the seal coating 36 that covers the PSA regions 32, 32' to the seal coating 36 that covers the center region 34. Furthermore, the first end seal 22 is formed by sealing together the inner surfaces of the sheet on the opposing portions along the first edge 24.

Figure 3:
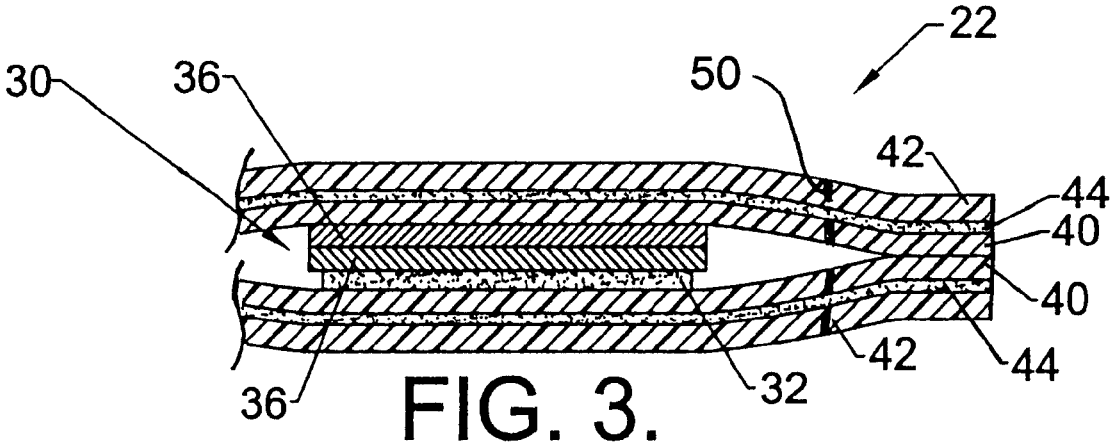
FIG. 3 is a cross-sectional view through the re-sealable seal, showing the seal in a closed condition.

FIG. 3 depicts a cross-section through the first end seal 22 and re-sealable seal 30. For clarity, the various layers of materials are shown with greatly exaggerated thicknesses. The first end seal 22 preferably is formed by a layer 40 of heat-sealable polymer material that forms the inner surface of the sheet 12. The heat-sealable layer 40 is laminated to a barrier layer 42 of the sheet via an intervening adhesive layer 44. The heat-sealable layer 40 can comprise various materials, including but not limited to oriented high-density polyethylene (OHDPE), oriented polypropylene (OPP). oriented polyester (OPES), cellophane, blown polyethylene, cast polypropylene (CPP), metallized versions of any of the aforementioned films, and others known in the art. The barrier layer 42 is optional, and when present, preferably provides a barrier against liquids and preferably also against gases, and can suitably be formed of, for example, polyethylene teraphthalate (PET) or the like. The package sheet preferably also includes one or more outer layers for providing abrasion resistance, strength, a print surface, etc., which outer layers can comprise various materials including OPP, OPET, cellophane, foil, paper, and the like. The end seal 22 is formed by heat sealing the heat-sealable layers 40 on the opposing portions of the sheet to each other. The end seal at the opposite end of the package and the fin seal 18 (FIG. 1) are also formed in this same manner.

Figure 4:
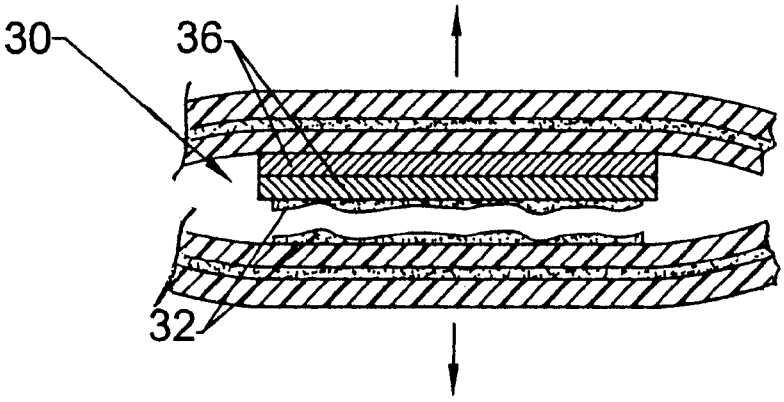
FIG. 4 is a view similar to FIG. 3. showing the re-sealable seal in an open condition.

The re-sealable seal 30, in the sealed condition depicted in FIG. 3, has the heat seal coatings 36 on the opposing portions of the sheet sealed to each other. Underlying the seal coating 36 on one of the sheet portions is the pressure-sensitive adhesive 32. The bonds between the heat seal coatings 36 and between the heat seal coating 36 and the underlying pressure-sensitive adhesive 32 are stronger than the bond between the pressure-sensitive adhesive 32 and the sheet portion to which it is applied. Accordingly. when the two opposing sheet portions are pulled apart, the pressure-sensitive adhesive 32 becomes detached from the sheet portion to which it was applied and remains with the other sheet portion, as shown in FIG. 4. The re-sealable seal 30 can then be re-sealed by pressing the sheet portions back together to cause the pressure-sensitive adhesive 32 to be reattached to the opposite sheet portion.

The pressure-sensitive adhesive 32 can be any suitable composition providing sufficient tack to hold the opposing portions of the sheet in face-to-face relation and prevent inadvertent opening of the package alter it has been reclosed. Where food is to be contained in the package. the pressure-sensitive adhesive must be approved for use by the FDA in accordance with 21 C.F.R. 175.300. Two suitable compositions available from ATO Findley, Inc. of Milwaukee, Wis., include CX-7106H01 and CX-7119H01 pressure-sensitive adhesives.

The seal coating 36 can be formed of various heat seal coating materials. As an example, the seal coating 36 preferably comprises the C4251A heat seal coating available from ATO Findley.

In accordance with a further preferred embodiment of the invention, the first end seal 22 can be torn from the package 10 by operating an easy-open feature 50 (FIG. 3) located between the first end seal 22 and the re-sealable seal 30. The easy-open feature 50 can comprise a line of perforations through the sheet 12, a tear strip formed in the sheet, a mechanically formed or laser-formed scoreline, or the like. In FIG. 4, the first end seal 22 has been torn from the package by operating the easy-open feature 50.

Figure 5:
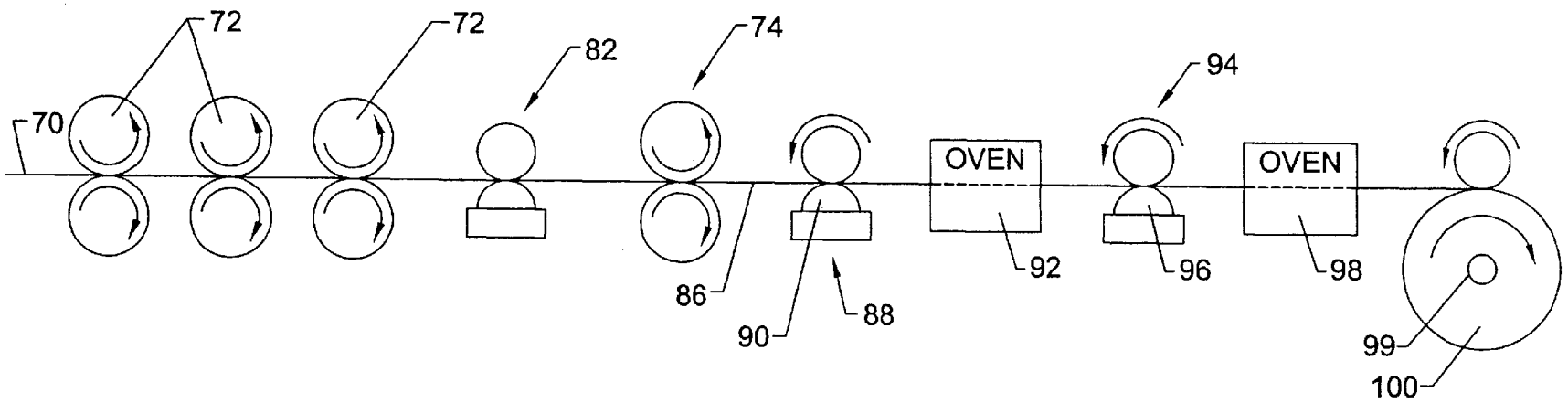
FIG. 5 is a schematic depiction of an apparatus and process for forming a flexible packaging sheet for use in making packages in accordance with the present invention.

In a preferred method for making the packages of the invention, a continuous web of sheet material is advanced and formed into packages as further described below. Advantageously, the web comprises a laminate having the barrier layer and heat-seal layer as described above. As schematically illustrated in FIG. 5, the web advantageously is manufactured in a printing press having a plurality of stations for performing various printing. laminating, and adhesive application functions. A first layer 70 that forms the outermost layer of a resulting package is passed through a plurality of printing stations 72 where identifying graphics and/or indicia are printed on the outer surface of the layer. Where the package sheet comprises a lamination, the layer 70 is then passed through a laminating station 74 where it is laminated to a heat-seal layer 76. Adhesive is applied to the outermost layer 70 (or, alternatively, to the heat-seal layer 76) at an adhesive applicator 82 and the outermost layer 70 is then laminated to the heat-seal layer 76. Alternatively, the layers 70 and 76 can be laminated together prior to having the graphics and/or indicia printed on the outer surface of the outer layer 70.

After exiting the laminating station 74, the resulting laminate 86 passes through a pressure-sensitive adhesive applicator 88 where pressure-sensitive adhesive is applied to the inner (product-facing) surface by a cylinder 90. The cylinder 90 has an etched or machined surface configured to apply the pressure-sensitive adhesive in a desired pattern, such as the pattern shown in FIG. 2. The laminate 86 is then passed through an oven 92 where the pressure-sensitive adhesive is dried. Next, the heat-seal coating is applied at an applicator 94 having an etched or machined cylinder 96. Finally, the laminate is passed through a second oven 98 to dry the heat seal coating, and the finished web is rolled onto a spool 99 for later use. The resulting roll 100 of web material may subsequently be processed by any suitable packaging machinery for forming packages in accordance with the invention.

Many modifications and other embodiments of the invention will come to mind to one skilled in the art to which this invention pertains having, the benefit of the teachings presented in the foregoing descriptions and the associated drawings. For example, although the illustrated and described package 10 has the end seal 22 disposed closer to the end of the package and the re-sealable seal 30 spaced farther inward from the end of the package, the locations of the end seal 22 and re-sealable seal 30 could be reversed such that the re-sealable seal 30 is the one closer to the end of the package, in which case the easy-open feature 50 could be omitted. Other modifications can also be made to the illustrative embodiment. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A flexible package for containing a product and having a reclosable opening feature, comprising:

a flexible sheet having a heat-sealable material on an inner surface of the sheet at least along opposite longitudinal edge portions and along opposite end edge portions of the sheet, the opposite longitudinal edge portions of the sheet being heat sealed together to create a permanent longitudinal seal so as to form a tube having opposite first and second ends;

a permanent first end seal formed proximate the first end of the tube so as to close the first end, and a permanent second end seal formed proximate the second end of the tube so as to close the second end, the permanent end seals being formed by heat sealing the heat-sealable material on opposing portions of the inner surface of the sheet together; and a re-sealable seal formed proximate one of the permanent seals, the re-sealable seal being formed by a pressure-sensitive adhesive applied to a first region of the inner layer of the sheet proximate the one permanent seal and a heat seal coating applied over the pressure-sensitive adhesive so as to cover the pressure-sensitive adhesive, and a heat seal coating applied over a second region of the inner surface of the sheet, the first and second regions of the inner surface being placed in contact with each other and having the heat seal coatings thereon heat scaled together.

2. The package of claim 1, wherein the re-sealable seal is formed adjacent the first end seal.

3. The package of claim 2, wherein the first region of the sheet to which the pressure-sensitive adhesive is applied comprises two separate areas spaced on opposite sides of a center region of the sheet, and the second region of the sheet occupies said center region, and wherein the sheet is folded so as to place said two separate areas in contact with said center region for forming the re-sealable seal.

4. The package of claim 2, wherein the first end seal is adjacent an edge of the sheet and the re-sealable seal is spaced from the first end seal in a direction toward the second end seal.

5. The package of claim 4, further comprising an opening feature formed in the sheet between the first end seal and the re-sealable seal.

6. The package of claim 5, wherein the opening feature is operable to enable a portion of the package having the first end seal to be torn off the package without disturbing the re-sealable seal.

7. A method for making a flexible package for products such that the package is reclosable after initial opening thereof comprising:

providing a generally rectangular flexible sheet having an inner surface and having a pressure-sensitive adhesive applied to a first region of the inner surface thereof, said first region being proximate a first edge of the sheet, the sheet having a heat seal coating applied over the pressure-sensitive adhesive such that the pressure-sensitive adhesive is covered by the heat seal coating, and a heat seal coating covering a second region of the inner surface of the sheet, the sheet further having a heat-sealable material on the inner surface thereof along at least opposite longitudinal edge portions and opposite end edge portions of the sheet;

heat sealing the opposite longitudinal edge portions of the sheet to each other via the heat-sealable material on the inner surface of the sheet to form a tube with a permanent longitudinal seal therealong, the first and second regions of the inner surface being located so as to be opposed to each other;

closing each of the ends of the tube by heat sealing opposing portions of the sheet to each other via the heat-sealable material on the inner surface of the sheet along the end edge portions thereof so as to form permanent First and second end seals, the first and second regions being adjacent one of the permanent seals; and bringing the first and second regions of the inner surface together and sealing the heat seal coatings on said regions to each other so as to form a re-sealable seal proximate said one of the end seals and longitudinal seal.

8. The method of claim 7, wherein a continuous web of flexible sheet material is advanced through a first applicator station that applies the pressure-sensitive adhesive onto the web at regular intervals spaced along the web, the web then being advanced through a second applicator station that applies the heat seal coatings onto the web in registration with the pressure-sensitive adhesive, a package being formed by separating a portion of the web from the remainder of the web while forming the longitudinal seal and the first and second end seals and re-sealable seal.

9. The method of claim 8, wherein the pressure-sensitive adhesive and heat seal coatings are applied to the web by rotating cylinders.

10. The method of claim 9, further comprising providing a supply of a continuous web of flexible sheet material having the pressure-sensitive adhesive and heat seal coatings applied thereto at regular intervals along the web, and wherein the web is advanced from said supply and a leading end portion of the advancing web is formed into a tube and is sealed along longitudinal and transverse seal lines to form the longitudinal seal and first and second end seals of the tube and to form the re-sealable seal, said leading end portion of the web being severed along transverse lines adjacent said first and second end seals to form an individual package.

11. The method of claim 10, wherein the advancing web is formed into a tube and two parallel transverse seals are formed across the tube closely adjacent and spaced from each other, one of said transverse seals forming the first end seal for one package and the other transverse seal forming the second end seal for an adjoining package.

12. The method of claim 7, wherein the pressure-sensitive adhesive is applied to the inner surface of the web in two separate areas spaced on opposite sides of a longitudinal center line of the web and the heat seal coating is applied over the pressure-sensitive adhesive and over a center portion of the web located inwardly of said two separate areas having the pressure-sensitive adhesive, and wherein the web is folded to place said two separate areas in contact with said center portion so as to form the re-sealable seal.

13. The method of claim 7, wherein the re-sealable seal is formed parallel to the first end seal.

14. The method of claim 13, wherein the re-sealable seal is formed at a location spaced from the first end seal in a direction toward the second end seal.

15. The method of claim 14, further comprising forming an easy-open feature between the first end seal and the re-sealable seal so as to enable the first end seal to be torn from the package without disturbing the re-sealable seal.

* * * * *